US008465296B1

(12) United States Patent
Lin et al.

(10) Patent No.: US 8,465,296 B1
(45) Date of Patent: Jun. 18, 2013

(54) ELECTRICAL CONNECTOR

(75) Inventors: Jui-Pin Lin, New Taipei (TW); Ming-Chun Lai, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/401,767

(22) Filed: Feb. 21, 2012

(51) Int. Cl.
*H01R 11/30* (2006.01)

(52) U.S. Cl.
USPC ..... 439/39

(58) Field of Classification Search
USPC ..... 439/38–40, 700
See application file for complete search history.

(56) References Cited

U.S. PATENT DOCUMENTS 7,311,526 B2 * 12/2007 Rohrbach et al. ..... 439/39
7,517,222 B2 * 4/2009 Rohrbach et al. ..... 439/39
7,901,216 B2 * 3/2011 Rohrbach et al. ..... 439/39
8,083,548 B1 * 12/2011 Lin ..... 439/607.34
8,087,939 B2 * 1/2012 Rohrbach et al. ..... 439/39
8,152,533 B1 * 4/2012 Lin ..... 439/39
8,177,560 B2 * 5/2012 Rohrbach et al. ..... 439/39
8,241,043 B1 * 8/2012 Lin ..... 439/39
8,388,354 B1 * 3/2013 Lin et al. ..... 439/39
2012/0083137 A1 * 4/2012 Rohrbach et al. ..... 439/39
2012/0148195 A1 * 6/2012 Umeno ..... 385/53

* cited by examiner

*Primary Examiner* — Ross Gushi

(57) ABSTRACT

An electrical connector includes an insulating housing, a plurality of probe pins assembled in the insulating housing, a magnetic block and a metal shell. The insulating housing has a base and a tongue extending frontward from a front of the base. The magnetic block has an inserting hole penetrating longitudinally therethrough and matched with the tongue of the insulating housing. The metal shell includes a first metal shell and a second metal shell. The first metal shell is assembled rearward through the tongue to enclose the base, and the magnetic block sheathes the tongue in the inserting hole. The second metal shell covers a front of the magnetic block and defines a positioning window for positioning a front end of the tongue therein. The second metal shell and the first metal shell are buckled and electrically connected with each other to clamp the magnetic block therebetween.

8 Claims, 3 Drawing Sheets

ELECTRICAL CONNECTOR

BACKGROUND OF THE INVENTION

1. Field of the Invention

The present invention relates to an electrical connector, and more particularly to an electrical connector adapted for connecting with a mated connector by virtue of magnetic attraction.

2. The Related Art

A traditional electrical connector connected with a mated connector by magnetic attraction generally includes an insulating housing, a plurality of probe pins and a magnetic mechanism assembled in the insulating housing respectively. In use, the interconnection between the electrical connector and the mated connector is apt to be influenced by the magnetic force of the magnetic mechanism. However, the size of the magnetic mechanism often affects the magnetic force of the magnetic mechanism. Moreover, the rapid developments of electronic products call for more stringent requirements to miniaturization of the electrical connector. As a result, the traditional electrical connector generally fails to meet the requirements of both miniaturization and strong magnetic force at the same time.

SUMMARY OF THE INVENTION

Accordingly, an object of the present invention is to provide an electrical connector. The electrical connector includes an insulating housing, a plurality of probe pins, a magnetic block, and a metal shell. The insulating housing has a base of substantially rectangular shape and a front of the base extends frontward to form a tongue. The insulating housing defines a plurality of inserting grooves longitudinally penetrating through the base and the tongue. The probe pins are inserted forward in the inserting grooves of the insulating housing respectively. The magnetic block has an inserting hole penetrating longitudinally through the magnetic block and matched with the tongue of the insulating housing. The metal shell includes a first metal shell and a second metal shell. The first metal shell is assembled rearward through the tongue to enclose the base. The magnetic block sheathes the tongue in the inserting hole. The second metal shell covers a front of the magnetic block and defines a positioning window for positioning a front end of the tongue therein and further exposing the front end of the tongue outside. The second metal shell and the first metal shell are buckled and electrically connected with each other to clamp the magnetic block therebetween.

As described above, the first metal shell is mounted to the insulating housing to enclose the base, the magnetic block is put around the tongue, and the second metal shell covers the front of the magnetic block and is connected with the first metal shell to clip the magnetic block therebetween. So, it can effectively make use of the inner space of the electrical connector and is in favor of enlarging the size of the magnetic block so as to reinforce the magnetic attraction between the electrical connector and a mating part, even though it is under the circumstances of no affecting the miniaturization of the electrical connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
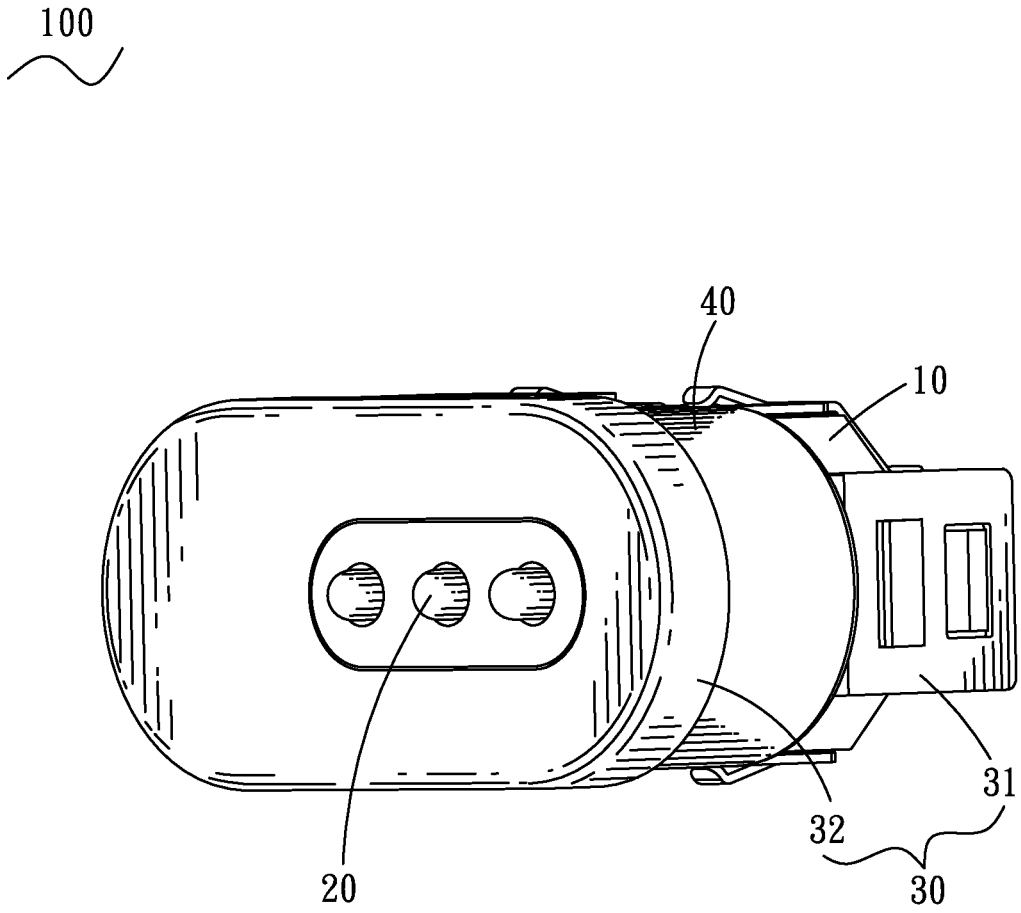
FIG. 1 is an assembled perspective view of an electrical connector according to the present invention.

Referring to the drawings in greater detail, and first to FIG. 1, an embodiment of the invention is embodied in an electrical connector 100. The electrical connector 100 includes an insulating housing 10, a plurality of probe pins 20 assembled in the insulating housing 10, a metal shell 30 and a magnetic block 40.

Figure 2:
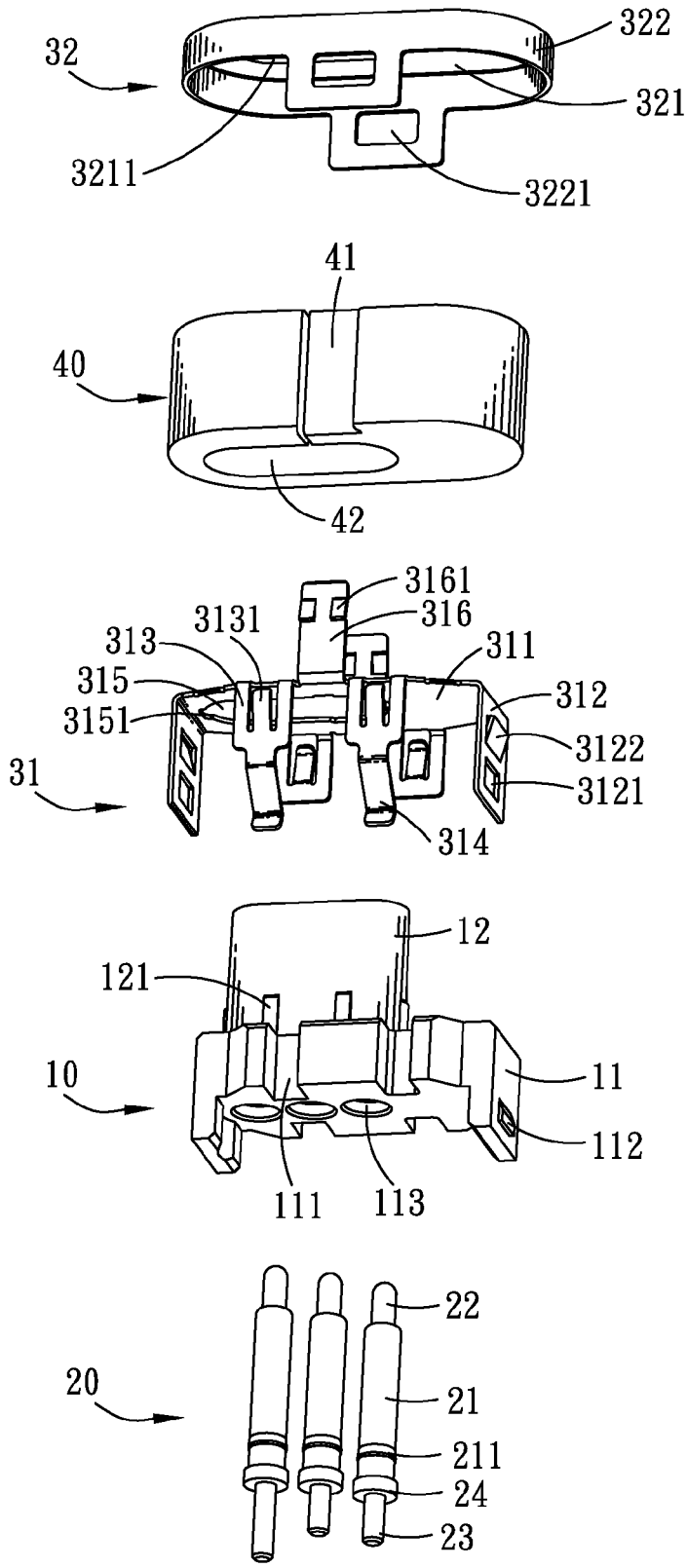
FIG. 2 is an exploded perspective view of the electrical connector shown in FIG. 1.
Figure 3:
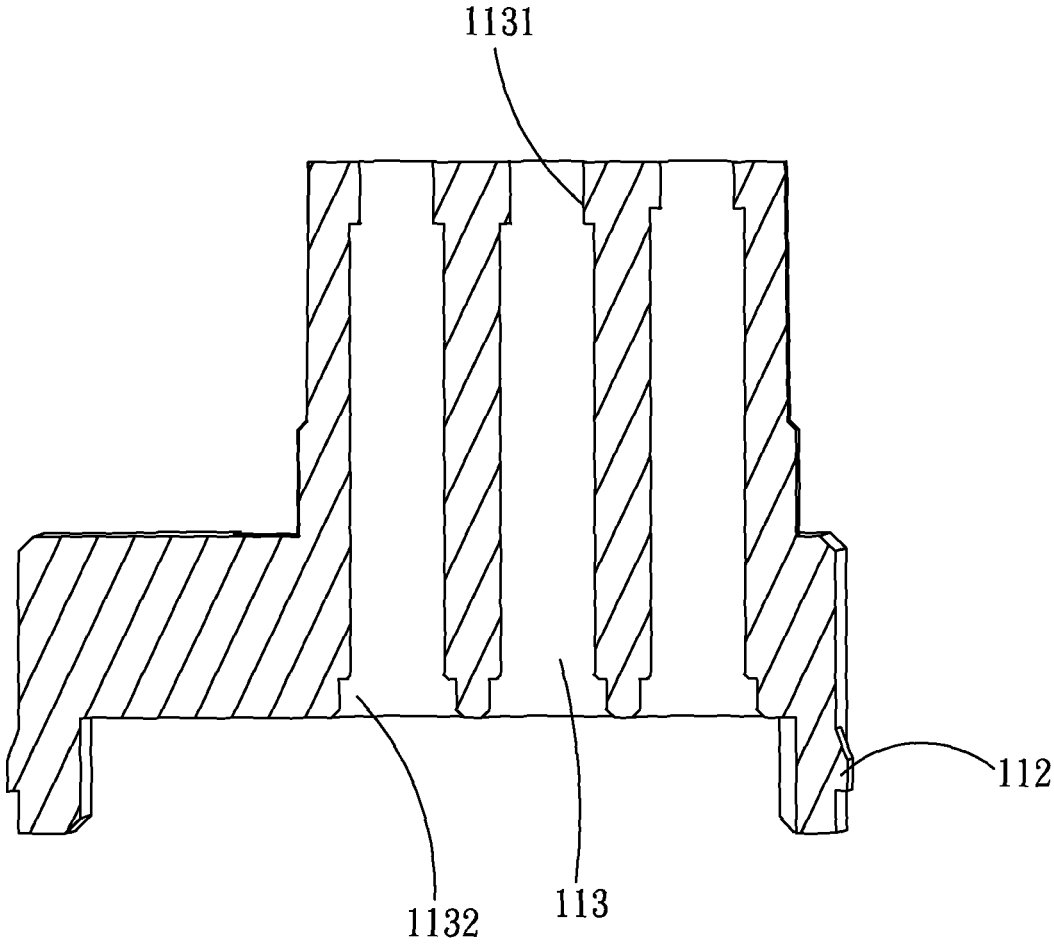
FIG. 3 is a cross-sectional view of an insulating housing of the electrical connector of FIG. 1.

With reference to FIGS. 1-3, the insulating housing 10 has a base 11 of substantially rectangular shape. A front of the base 11 extends frontward to form a tongue 12 having a smaller dimension than the base 11. The insulating housing 10 defines a plurality of inserting grooves 113 longitudinally penetrating through the base 11 and the tongue 12. An inner sidewall of the inserting groove 113 has a front portion thereof protruded inward to form a ring-shaped blocking wall 1131, and has a rear portion thereof concaved inward to form a circular blocking groove 1132. A top and a bottom of the base 11 respectively define two receiving fillisters 111 transversely spaced from each other. Two opposite side faces of the base 11 protrude outward to form a buckle block 112 respectively. A periphery outer side of the tongue 12 protrudes outward to form a plurality of fastening ribs 121 spaced from one another and each extending longitudinally to connect the front of the base 11.

Referring to FIG. 2, each of the probe pins 20 includes a cylindraceous barrel 21 and a plunger 22 made of metal material. The barrel 21 has a rear end thereof sealed up and a front end thereof opened freely. The plunger 22 is retractably restrained in the barrel 21 by means of an elastic element (not shown) elastically positioned between the plunger 22 and the barrel 21, with a front end thereof stretching outside from the opened front end of the barrel 21. A periphery outside of the barrel 21 protrudes outward to form a ring-shaped blocking portion 24 at the rear end of the barrel 21, and a fastening portion 211 apart from the blocking portion 24 and having a smaller outer diameter than that of the blocking portion 24. The rear end of the barrel 21 extends rearward to form a soldering portion 23.

Referring to FIGS. 1-2, the metal shell 30 includes a first metal shell 31 and a second metal shell 32. The first metal shell 31 has a front plate 311 with an inserting window 315 opened therein and matched with the tongue 12. A plurality of fastening gaps 3151 is apart opened in a periphery inner edge of the inserting window 315. The tongue 12 passes through the inserting window 315 to make the front plate 311 abut against the front of the base 11, and the fastening ribs 121 are snapped in the corresponding fastening gaps 3151. Top and bottom edges of the front plate 311 protrude rearward to form a plurality of resisting plates 313 clamping the top and the bottom of the base 11, and extend forward to form a pair of connecting plates 316 with buckle ears 3161 oppositely protruding outward on fronts thereof. Each of the resisting plates 313 covers one of the receiving fillisters 111 of the base 11 and is punched outward to form an elastic slice 3131 capable of being elastically pressed into the corresponding receiving fillister 111. The resisting plates 313 connected with the top edge of the front plate 311 further slantwise extend rearward to form two touching slices 314 stretching behind the base 11. Two opposite side edges of the front plate 311 extend rearward to form a pair of side plates 312 attached on two opposite side faces of the base 11, and each of the side plates 312 defines a buckle hole 3121 buckling the buckle block 112 therein and a locking slice 3122 locking a mating part (not shown).

Referring to FIG. 1 and FIG. 2, the magnetic block 40 is a unitary block with an inserting hole 42 penetrating longitudinally therethrough and matched with the tongue 12 of the insulating housing 10. In this embodiment, the magnetic block 40 is of a substantial elliptic shape from a front view. The magnetic block 40 sheathes the tongue 12 in the inserting hole 42 to make the front plate 311 of the first metal shell 31 clipped between the magnetic block 40 and the base 11. The fastening ribs 12 abut against a periphery inner sidewall of the inserting hole 42 to secure the magnetic block 40 and the tongue 12 together. A top and a bottom of the magnetic block 40 are concaved inward to respectively define a fastening fillister 41 penetrating longitudinally through the magnetic block 40 for inserting the corresponding connecting plate 316 therein.

Referring to FIGS. 1-3, the second metal shell 32 has a cover plate 321 with a positioning window 3211 opened therein. The cover plate 321 is covered on the front of the magnetic block 40 with a front end of the tongue 12 positioned in the positioning window 3211, and a periphery outer edge thereof protrudes rearward to form a positioning ring 322 surrounding the front of the magnetic block 40. A pair of locking parts 3221 protrudes rearward from substantial middles of rear edges of top and bottom of the positioning ring 322 for buckling with the buckle ears 3161 of the connecting plates 316 so as to realize an electrical connection and further firmly clamp the magnetic block 40 between the first metal shell 31 and the second metal shell 32. The probe pin 20 is inserted forward in the inserting groove 113 of the insulating housing 10 with the front end of the barrel 21 resisting against a rear of the blocking wall 1131. The blocking portion 24 is positioned in the blocking groove 1132, and the fastening portion 211 abuts against a periphery inner side of the inserting groove 113 to secure the barrel 21 in the inserting groove 113. The plunger 22 retractably stretches forward out of the inserting groove 113 and beyond a front side of the cover plate 321 for electrically contacting with the mating part. The soldering portions 23 project behind the base 11 for being soldered with an external printed circuit board (not shown).

As described above, the first metal shell 31 is mounted to the insulating housing 10 to enclose the base 11, the magnetic block 40 is put around the tongue 12, and the second metal shell 32 covers the front of the magnetic block 40 and is connected with the first metal shell 31 to clip the magnetic block 40 therebetween. So, it can effectively make use of the inner space of the electrical connector 100 and is in favor of enlarging the size of the magnetic block 40 so as to reinforce the magnetic attraction between the electrical connector 100 and the mating part, even though it is under the circumstances of no affecting the miniaturization of the electrical connector 100.

What is claimed is:

1. An electrical connector, comprising:

an insulating housing having a base of substantially rectangular shape, a front of the base extending frontward to form a tongue, the insulating housing defining a plurality of inserting grooves longitudinally penetrating through the base and the tongue;

a plurality of probe pins inserted forward in the inserting grooves of the insulating housing respectively;

a magnetic block of a unitary block having an inserting hole penetrating longitudinally through the magnetic block and matched with the tongue of the insulating housing; and a metal shell including a first metal shell and a second metal shell, the first metal shell being assembled rearward through the tongue to enclose the base, the magnetic block sheathing the tongue in the inserting hole, the second metal shell covering a front of the magnetic block and defining a positioning window for positioning a front end of the tongue therein and further exposing the front end of the tongue outside, the second metal shell and the first metal shell being buckled and electrically connected with each other to clamp the magnetic block therebetween.

2. The electrical connector as claimed in claim 1, wherein the first metal shell has a front plate with an inserting window opened therein and matched with the tongue, the tongue passes through the inserting window to make the front plate abut against the front of the base, top and bottom edges of the front plate protrude rearward to form a plurality of resisting plates clamping a top and a bottom of the base, and extend forward to form a pair of connecting plates attached on a top and a bottom of the magnetic block with buckle ears oppositely protruding outward on fronts thereof, two opposite side edges of the front plate extend rearward to form a pair of side plates attached on two opposite side faces of the base, the second metal shell has a cover plate with the positioning window opened therein, a pair of locking parts protrudes rearward from top and bottom of the cover plate, the cover plate is covered on the front of the magnetic block and the locking parts buckle with the buckle ears of the connecting plates.

3. The electrical connector as claimed in claim 2, wherein the two opposite side faces of the base protrude outward to form a buckle block respectively, each of the side plates defines a buckle hole buckling the buckle block therein.

4. The electrical connector as claimed in claim 2, wherein the top and the bottom of the base respectively define two receiving fillisters transversely spaced from each other, each of the resisting plates covers one of the receiving fillisters and is punched outward to form an elastic slice capable of being elastically pressed into the corresponding receiving fillister.

5. The electrical connector as claimed in claim 2, wherein the resisting plates connected with the top edge of the front plate further slantwise extend rearward to form two touching slices stretching behind the base.

6. The electrical connector as claimed in claim 2, wherein a periphery outer side of the tongue protrudes outward to form a plurality of fastening ribs spaced from one another and each extending longitudinally to connect the front of the base, a plurality of fastening gaps is apart opened in a periphery inner edge of the inserting window of the front plate and snaps the corresponding fastening ribs therein, the fastening ribs further interfere with a periphery inner sidewall of the inserting hole to secure the magnetic block around the tongue.

7. The electrical connector as claimed in claim 2, wherein the top and the bottom of the magnetic block are concaved inward to respectively define a fastening fillister penetrating longitudinally through the magnetic block for inserting the corresponding connecting plate therein.

8. The electrical connector as claimed in claim 2, wherein a periphery outer edge of the cover plate protrudes rearward to form a positioning ring surrounding the front of the magnetic block, the locking parts protrude rearward from substantial middles of rear edges of the top and bottom of the positioning ring.

* * * * *